United States Patent [19]

Pasternack

[11] Patent Number: 5,048,517

[45] Date of Patent: Sep. 17, 1991

[54] RECIRCULATING POSITIVE-PRESSURE RESPIRATOR

[75] Inventor: Adalbert Pasternack, Bad Schwartau, Fed. Rep. of Germany

[73] Assignee: Drägerwerk Aktiengesellschaft, Lübeck, Fed. Rep. of Germany

[21] Appl. No.: 467,643

[22] Filed: Jan. 19, 1990

[30] Foreign Application Priority Data

Jan. 20, 1989 [DE] Fed. Rep. of Germany ..... 3901581

[51] Int. Cl.[5] ..... A62B 7/10

[52] U.S. Cl. ..... 128/205.28; 128/205.13; 128/202.26

[58] Field of Search ..... 128/202.26, 205.28, 128/205.13, 205.14

[56] References Cited

U.S. PATENT DOCUMENTS

| | | | |
|---|---|---|---|
| 819,704 | 5/1906 | Bamberger et al. | 128/202.26 |
| 3,815,592 | 6/1974 | Staub, Jr. | 128/202.26 |
| 4,157,091 | 6/1979 | Pampuch | 128/202.26 |
| 4,195,627 | 4/1980 | Haertle | 128/205.28 |
| 4,498,470 | 2/1985 | Warncke | 128/202.26 |

FOREIGN PATENT DOCUMENTS 2421297 11/1974 Fed. Rep. of Germany .

*Primary Examiner*—Aaron J. Lewis
*Attorney, Agent, or Firm*—McGlew & Tuttle

[57] ABSTRACT

A respirator for recirculating breathing gases, comprises an expiration bag in which an internal tension spring is provided for compressing the bag, and an inspiration bag which can be connected to a respiration gas source. A $CO_2$-binding chemical cartridge and an oxygen source is arranged in the respiratory circuit. A space-saving arrangement of the tension spring provided in the breathing bag is also used to generate a positive pressure in the entire respiratory circuit. The positive pressure exercised by the tension springs in the respiratory circuit can be reduced rapidly if necessary, and the operation can be continued under normal pressure. To achieve this, the inspiration bag 11 is provided with an internally disposed pre-tensioning spring 101 serving to compress the inspiration bag.

5 Claims, 2 Drawing Sheets

RECIRCULATING POSITIVE-PRESSURE RESPIRATOR

FIELD AND BACKGROUND OF THE INVENTION

The invention relates in general to respiration and particularly pertains to a respirator and respiratory method intended for recirculating operation, using an expiration bag, in which an internal tension spring is provided for compressing the expiration bag, and also inspiration bag, which can be connected to a respiratiсn gas source, having a $CO_2$-binding chemical cartridge and an oxygen source arranged in the respiratory circuit between inspiration bag and the expiration bag.

A similar respirator has become known from West German Patent Specification No. 24,21,297 in which the prior-art respirator has an expiration bag, whose mobile, opposite end faces can be drawn together by an internal tension spring, so that the contents of the filled expiration bag are pressed through the chemical cartridge in the expiration branch of the respiratory circulating line. The positive pressure occurring in the expiration line disappears during the flow through the chemical cartridge, so that the user of the respirator must inhale the regenerated expired air during the inspiration phase, while a vacuum is being generated. The vacuum thus generated in the inspiration system may lead to the undesired penetration of toxic substances into the respiratory circuit in the case of leakage of the ambient air that may be enriched with toxic substances. The construction and use of the expiration bag of the prior-art respirator is unable to guarantee a positive pressure in the entire respiratory circuit, because the positive pressure in the expiration bag cannot extend into the inspiration branch due to the check valve, and it will be abolished by the downstream regenerating cartridge during the passage through the cartridge.

SUMMARY OF THE INVENTION

The present invention provides a respirator in which the space-saving arrangement of a tension spring in the breathing bag is utilized to generate positive pressure in the entire respiratory circuit. For this method the inspiration bag with an internally located pre-tensioning spring is used to compress the bag.

An advantage of the present invention is that the respirator can be of small volume, and positive pressure is maintained in the respiratory circuit even during the phase of inspiration, and the corresponding tension springs can be dimensioned smaller in the divided design comprising an inspiration bag and an expiration bag than would be necessary in the case of a one-piece design of a breathing bag, because each of the springs has to move a smaller mass and to act against a weaker pressing force.

The advantage of the arrangement of the internal tension springs in the respective inspiration and expiration bags can also be utilized for respirators operating in the positive pressure range. This advantage being that the points of attachment for the tension springs can now be disposed inside the breathing bags and, unlike in the case of compression springs, it is no longer necessary to find a support point for the tension springs pressing from the outside against the breathing bag on the housing of the respirator proper. This usually leads to large external dimensions of the positive pressure respirators.

It may be particularly advantageous to attach the tension spring and the pre-tensioning spring between a point of attachment between the chemical cartridge, and a holding wall, which represents a partial area of the wall of the inspiration bag and of the expiration bag. This leads to a particularly space-saving arrangement of the breathing bags and the chemical cartridge. The breathing bags are now located immediately in front of the inlet opening expiration bag and the outlet opening inspiration bag of the chemical cartridge, so that the shortest possible respiration gas paths are realized.

It appears particularly advantageous to provide the points of attachment on a movable holding wall of the chemical cartridge and to place them on a common connecting piece. The connecting piece penetrates the chemical cartridge, is mounted displaceably in a sealing friction mount, and is supported toward each of the points of attachment by one displaceable tension spring each. This arrangement causes the tension springs in the breathing bags to mutually influence each other. Thus, when one of the tension springs is drawn together, the displacing tension spring associated with it will displace the holding wall to which it is attached farther toward the regenerating cartridge, and the undesired dead space between the holding wall and the regenerating cartridge is further reduced.

It is advantageous to retain at least one of the tension springs at its point of attachment by a detachable connecting member. Under certain circumstances, e.g., in the case of excessive leakage in the respiratory circuit, it is necessary to render the means generating positive pressure inoperative in order to prevent respiration air from continuously escaping and consequently from being removed from the circulation via the leak due to the force producing the positive pressure. This would lead to rapid oxygen consumption and expose the user of the respirator to risks. Therefore, if a considerable leakage is detected, one of the tension springs, either that in the inspiration bag or that in the expiration bag, or both tension springs, can be released, so that recirculating respiration ca continue to take place without positive pressure.

The connecting member preferably comprises a split pin which is passed through both a sleeve attached to the point of attachment and a bolt that is connected to the pre-tensioning spring and/or the tension spring and is held in the sleeve and can be removed from the bolt by traction means. The traction means may be, e.g., a traction rope led out of the respirator. The rope can be pulled by the user of the respirator when needed, whereupon the split pin is pulled through both the bolt and the sleeve and the tension spring will thus jump out of its point of attachment.

The present invention can be used advantageously for recirculating respirators which have a $CO_2$-binding chemical cartridge with an oxygen tank as an oxygen source, in which case the oxygen needed is delivered into the inspiration ba9 by means of a valve operated automatically by the lung function, as well as in respirators which have a $CO_2$-binding and oxygen-releasing regenerating cartridge.

Accordingly it is an object of the invention to provide an improved respirator in which bags are provided both for connection to inspiration and expiration lines and they are connected together so that springs arranged in these bags are aided both during inspiration and respiration by action of the springs in the respective bags.

A further object of the invention is to provide a respirator which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
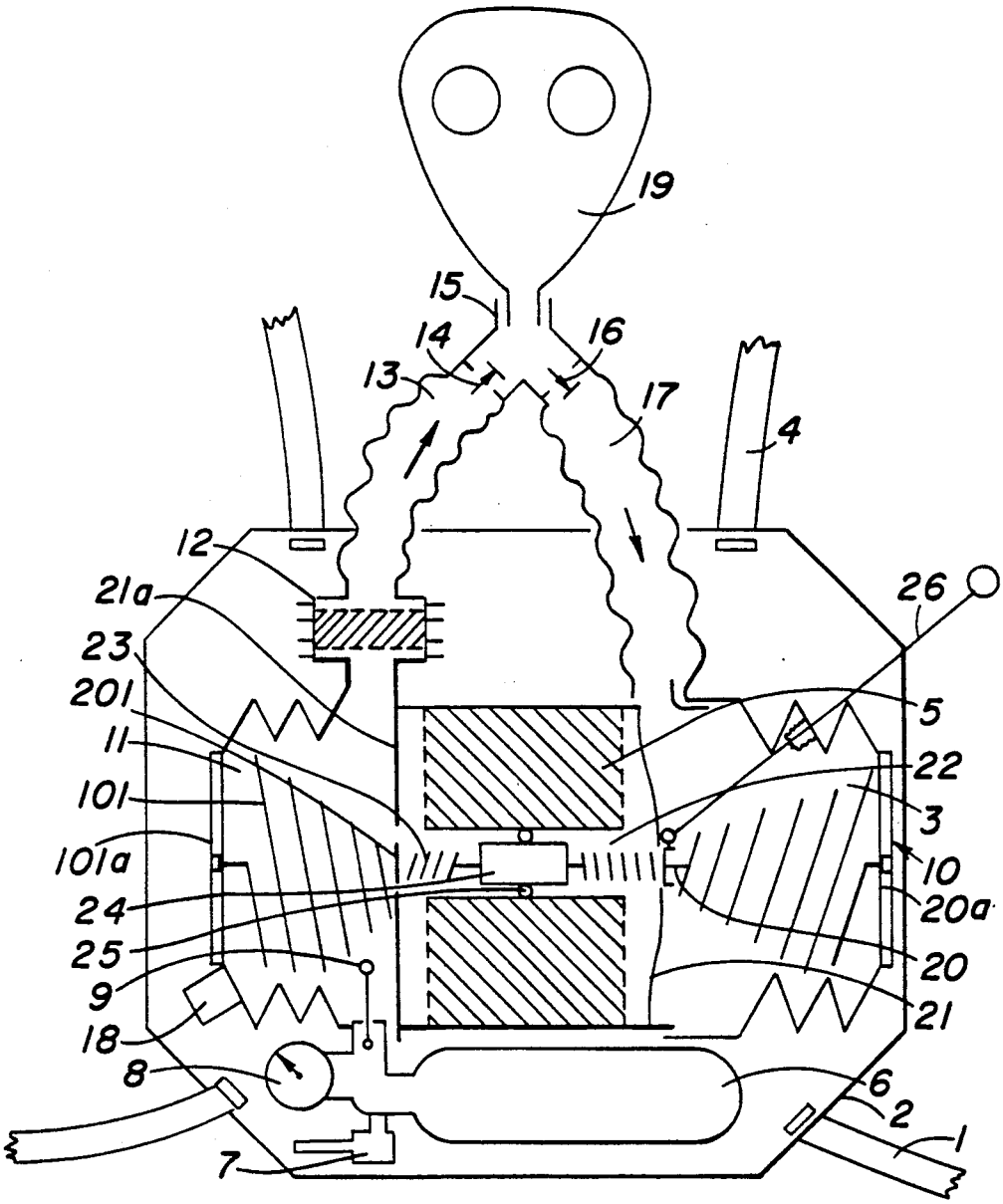
FIG. 1 is a schematic transverse sectional view of a respirator for recirculating operation with positive pressure constructed in accordance with the invention; and, FIG. 2 is an enlarged sectional detail of a detachable connection between the point of attachment and the tension spring.

Referring to the drawings in particular the invention embodied therein comprises a respirator which in the embodiment shown comprises a respirator which can be carried by a person and includes a mask 19 which can be arranged over the person's face.

FIG. 1 shows a respirator including a respiratory circuit whose housing 2 can for example be held on the back or chest of a user of the respirator not shown via a waist belt 1 and the carrying strap 4. A mask 19 is connected at a connecting piece 15 to both an inspiration tube 13 and an expiration tube 17, which contain an inspiration valve 14 and an expiration valve 16, respectively. The expiration tube 17 opens into an expiration bag 3, in which a tension spring or tension spring assembly 10 is accommodated between point of attachment or end piece 20 and a reinforced breathing bag wall 20*a*.

The inspiration tube 14 opens via a heat exchanger 12 into an inspiration bag 11 which contains a pre-tensioning spring 101. Similarly the spring 101 is connected between a point of attachment 201, and a reinforced wall part 101*a* of inspiration bag 11. Both the expiration bag 3 and the inspiration bag 11 are in a flow communication opening, a path 22 with a $CO_2$-binding chemical cartridge 5 arranged between them. The points of attachment 20 and 201 are arranged in the vicinity of the openings of respective flexible holding walls 21 and 21*a*. The walls 21 and 21*a* also form side walls of a housing for the chemical cartridge 5.

In the middle of the cartridge, opposite the points of attachment 20 and 201, the opening 22 is provided through the cartridge 5, in which a connecting piece 24 is held displaceably via an O ring 25 surrounding its circumference in a sealing manner. The points of attachment 20 and 201 themselves are connected to the connecting piece 24 by cable tension springs 23.

To supply the respiratory circuit with oxygen, an oxygen tank 6 is provided, which is connected to the inspiration bag 11 via a valve 9 operated automatically by the lung function. A pressure reducing valve 8 ensures the necessary oxygen pressure, and a warning device indicates the state of an oxygen tank that is emptied to a residual volume.

A safety valve 18 in inspiration bag 11 releases any excess pressure that may be present in the recirculating system into the atmosphere. The tension spring 10 of the expiration bag 3 is attached at its point of attachment 20 to a detachable connection, which can be separated from the tension spring 10 by traction means 26 which is led out of the housing 2.

Figure 2:
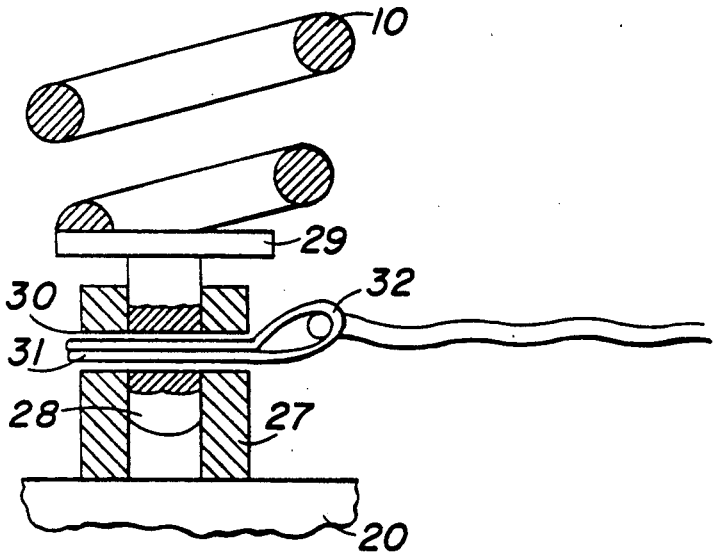

FIG. 2 shows the detachable connecting member in detail. The point of attachment 20 carries a sleeve 27 into which reaches a pin 28 whose head piece 29 is fastened to the pointed end of the conical tension spring 10. A bore 30 passes through the pin 28 and the sleeve 27 and receives a split pin 31, which has an eyelet 32. The traction means 26 designed as a pull cord is led through the eyelet 32.

While a specific embodiment of the invention has been shown and described in detail to illustrate the application of the principals of the invention, it will be understood that the invention may be embodied otherwise without departing from such principals.

What is claimed is:

1. A respirator for recirculation operation, comprising: a respiratory circuit including an expiration line; an expiration bag connected to said expiration line; internally disposed tension spring in said expiration bag for compressing said expiration bag; an inspiration gas line connected to an oxygen souce; a carbon dioxide binding chemical cartridge and said oxygen source arranged in said respiratory circuit between said inspiration bag and said expiration bag; and, an internally disposed pre-tensioning spring connected to said inspiration bag to compress siad inspiration bag.

2. A respirator according to claim 1 including an attachment point of said tension spring and said pre-tensioning spring disposed on respective sides of said chemical cartridge interconnecting said tension spring and said pre-tensioning spring, said tension spring and said pre-tensioning spring including ends opposite to said point of attachment in contact with a partial area of the wall of said inspiration bag and said expiration bag respectively.

3. A respirator according to claim 2 wherein said chemical cartridge includes a passage therethrough between said tensioning spring and said pre-tensioning spring, a connecting piece disposed in said opening and a friction mount in said opening holding said connection piece and permitting relative movement thereof in said opening said connecting piece being connected at respective ends through said tensioning spring and said pre-tensioning spring respectively.

4. A respirator according to claim 3 including a detachable connecting member interconnecting at least one of said tensioning spring and said pre-tensioning spring to said connecting piece.

5. A respirator according to claim 4 wherein said detachable connecting member comprises a split pin and including a sleeve connected to an attachment point of one of said springs and a pin having a headpiece connected to the other of said springs engaged in said sleeve and having an opening therethrough which aligns with an opening of said sleeve and including a pin in said opening and holding said pin in said sleeve and a traction member connected to said pin for pulling said pin so that it does not hold said bolt.

* * * * *